US007909296B2

(12) United States Patent
Moran-Grover et al.

(10) Patent No.: US 7,909,296 B2
(45) Date of Patent: Mar. 22, 2011

(54) DISPLAY WITH ADJUSTABLE BRACKET

(75) Inventors: Melanie Moran-Grover, Maplewood, MN (US); Christine Welsh, Stillwater, MN (US); Mark Waite, Coon Rapids, MN (US)

(73) Assignee: Target Brands, Inc., Minneapolis, MN (US)

( * ) Notice: Subject to any disclaimer, the term of this patent is extended or adjusted under 35 U.S.C. 154(b) by 522 days.

(21) Appl. No.: 12/111,706

(22) Filed: Apr. 29, 2008

(65) Prior Publication Data

US 2009/0266960 A1 Oct. 29, 2009

(51) Int. Cl.
*A47G 29/00* (2006.01)

(52) U.S. Cl. ..... 248/220.21; 211/103

(58) Field of Classification Search ..... 211/103, 211/190, 207, 175, 41.15; 248/220.21, 220.31, 248/220.43, 221.11, 278.1
See application file for complete search history.

(56) References Cited

U.S. PATENT DOCUMENTS

| | | | | |
|---|---|---|---|---|
| 1,881,736 | A | | 10/1932 | Lichter |
| 2,074,928 | A | | 3/1937 | Miller |
| 2,867,918 | A | | 1/1959 | Miller |
| 3,824,725 | A | | 7/1974 | Friedrichsen |
| 4,356,647 | A | | 11/1982 | Farris |
| 4,459,773 | A | | 7/1984 | Sandlin et al. |
| 4,611,866 | A | | 9/1986 | Everett |
| 4,698,928 | A | | 10/1987 | Soporowski |
| 4,798,013 | A | | 1/1989 | Sainato |
| 4,899,974 | A | | 2/1990 | Wear et al. |
| 5,096,069 | A | | 3/1992 | Brandon |
| 5,375,802 | A | * | 12/1994 | Branham, II ..... 248/221.11 |
| 5,437,116 | A | | 8/1995 | Hardy |
| 5,495,653 | A | * | 3/1996 | Schrock et al. ..... 29/401.1 |
| 5,624,044 | A | | 4/1997 | Black, Jr. |
| 5,732,916 | A | * | 3/1998 | Gordon ..... 248/220.41 |
| 5,803,420 | A | | 9/1998 | Conway et al. |
| 5,924,367 | A | | 7/1999 | Henke et al. |
| 6,003,697 | A | | 12/1999 | Ferchat et al. |
| 6,015,124 | A | | 1/2000 | Loy |
| 6,023,867 | A | | 2/2000 | Gagne |
| 6,470,611 | B1 | | 10/2002 | Conway et al. |
| D487,354 | S | | 3/2004 | Hahn |

(Continued)

FOREIGN PATENT DOCUMENTS

GB 2047519 A * 12/1980

OTHER PUBLICATIONS

Target Corporation, "Hosiery-Assets Shapewear Header Instructions," 4 pp., provides a description of methods and apparatuses known, used, or sold prior to Apr. 11, 2007, although no assertion is made that this document itself was publicly available at that time.

(Continued)

*Primary Examiner* — Ramon O Ramirez
(74) *Attorney, Agent, or Firm* — Nixon & Vanderhye P.C.

(57) ABSTRACT

A display system includes a housing and a support bar. The housing has a front face and a rear face. The support bar includes an elongate body and a first bracket. The elongate body has a front face and a channel. The first bracket is secured within the channel of the elongate body and is adjustable relative to the housing in two substantially perpendicular directions. The rear face of the housing is secured to the front face of the support bar.

18 Claims, 15 Drawing Sheets

U.S. PATENT DOCUMENTS

| | | | | |
|---|---|---|---|---|
| D495,501 | S | 9/2004 | Hahn | |
| D495,502 | S | 9/2004 | Hahn | |
| D495,503 | S | 9/2004 | Hahn | |
| D498,063 | S | 11/2004 | Hahn | |
| D499,888 | S | 12/2004 | Hahn | |
| D499,889 | S | 12/2004 | Hahn | |
| D503,045 | S | 3/2005 | Hahn | |
| 6,895,704 | B2 | 5/2005 | Ives et al. | |
| 6,996,929 | B1 | 2/2006 | Greene, Jr. et al. | |
| 7,494,101 | B2 * | 2/2009 | Chen | 248/298.1 |
| 2004/0098895 | A1 | 5/2004 | Sparkowski | |
| 2006/0021269 | A1 | 2/2006 | Doctoroff | |
| 2008/0203040 | A1 * | 8/2008 | Kologe | 211/103 |
| 2009/0120888 | A1 * | 5/2009 | Himes | 211/103 |

OTHER PUBLICATIONS

Target Corporation, "Backer Paper In-Store Marketing Signing Instructions," 1 pg., provides a description of methods and apparatuses known, used, or sold prior to Apr. 11, 2007, although no assertion is made that this document itself was publicly available at that time.

Target Corporation, "Hosiery Bar Drawing," 1 pg., provides a description of apparatuses known, used, or sold prior to Apr. 11, 2007, although no assertion is made that this document itself was publicly available at that time.

Christine Arradondo et al., "Systems and Methods for Displaying Backer Material," U.S. Appl. No. 11/734,205, filed Apr. 11, 2007 (28 pgs.).

* cited by examiner

DISPLAY WITH ADJUSTABLE BRACKET

BACKGROUND

Various types of displays are used to support and present merchandise to consumers in a retail environment. Displays that are eye-catching and that readily provide information about a product help draw the attention of the customer and promote retail sales. Additionally, displays that are able to be efficiently set up, broken down, and adjustable are versatile and adaptable for use with different base fixtures or mounts. Such displays provide a more efficient use of resources, including better use of employee time and reduced costs via cross-compatibility. As such, it is desirable to provide display systems characterized as visually pleasing, informative, adaptable and readily assembled. While traditional displays accomplish these features to some extent, enhancements in the functionality, or overall merchandising effectiveness, of such displays remain to be realized.

SUMMARY

Some aspects relate to a display system including a housing and a support bar. The housing has a front face and a rear face. The support bar includes an elongate body and a first bracket. The elongate body has a front face and a channel. The first bracket is secured within the channel of the elongate body and is adjustable relative to the housing in two substantially perpendicular directions. The rear face of the housing is secured to the front face of the support bar.

Some aspects relate to a merchandising system including a transparent casing for housing signs, a member, first means for releasably securing the member to a first fixation device and second means for releasably securing the member to a second fixation device. The member has an extended portion and means for releasably attaching the member to the transparent casing. At least one of the first means and second means is adjustable in a first direction and a second direction.

Some aspects relate to a method of displaying a sign including releasably attaching a channel assembly having a channel member, a first bracket and a second bracket to a retail accessory, adjusting an overall length of the channel assembly to correspond to a distance between a first attachment site defined by a first standard and a second attachment site defined by a second standard, adjusting an overall height of the first bracket and the second bracket relative to the channel member, and releasably securing the channel assembly to the first and second attachment sites to hang the signholder in a substantially upright position from the first and second standards. The first bracket and the second bracket are secured at opposite ends of the channel member. The first bracket includes a slide portion and a tooth portion. The slide portion includes a slot for receiving a pin to limit substantially horizontal adjustment and substantially vertical adjustment of the slide portion relative to the ends of the channel member. The tooth portion is adapted to be inserted into and releasably retained within the first standard.

Various other aspects are contemplated and should be understood with reference to the text and drawings that follow.

Figure 1:
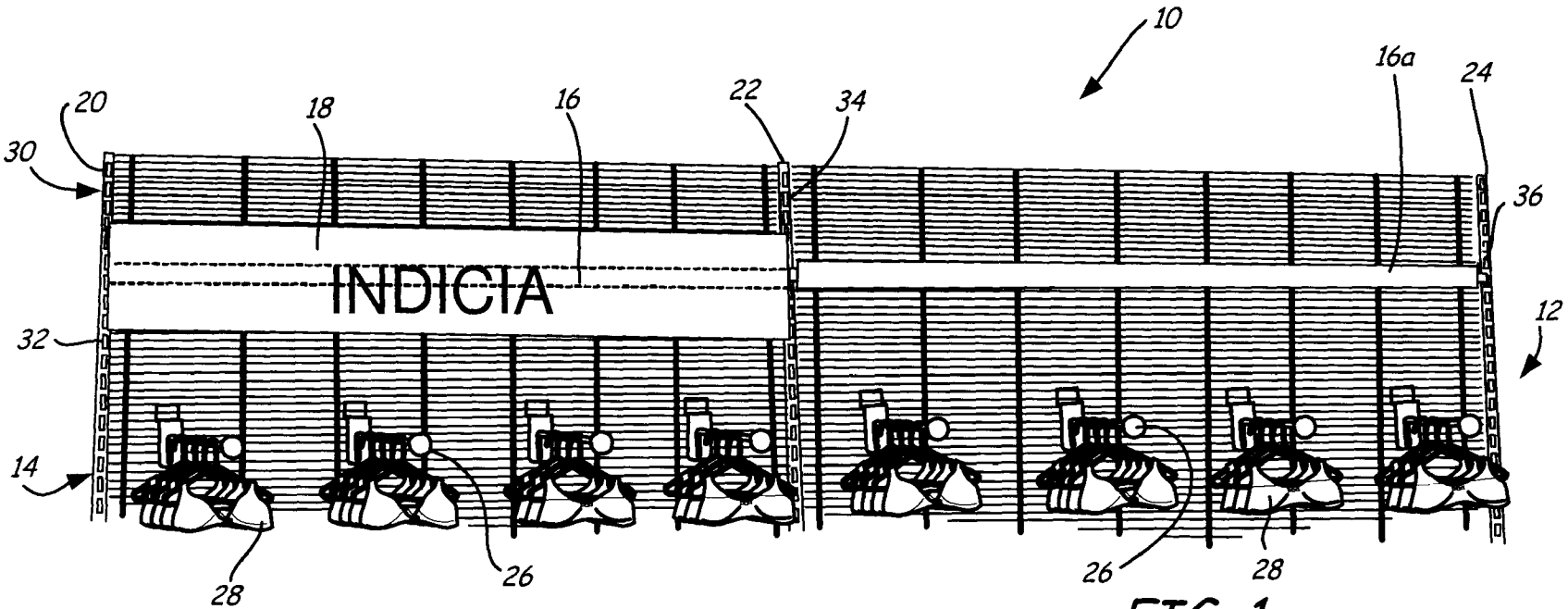
FIG. 1 is perspective view of a display system, according to some embodiments.

While the invention is amenable to various modifications and alternative forms, some embodiments have been shown by way of example in the drawings and are described in detail below. As alluded to above, the intention, however, is not to limit the invention by those examples. On the contrary, the invention is intended to cover all modifications, equivalents, and alternatives.

DETAILED DESCRIPTION

In some embodiments, a display system includes a signholder that is adjustable in at least two directions relative to a base fixture to which the signholder is attached. For example, the signholder is optionally attached to a support bar that includes a set of brackets that are positionable at various locations relative to the support bar. The brackets are moved in a first, telescoping direction to mount the signholder to substantially vertical uprights that are spaced from each other at varying distances. The brackets are moved in a second, up/down direction to mount the signholder at varying heights relative to the base fixture within holes spaced from each other at varying distances along a length of the substantially vertical uprights. Additionally, the brackets are shaped to allow them to be mounted to substantially vertical uprights having holes or apertures of varying heights and thicknesses. The versatility and ease of adjustablility of the display system, for example, presents a variety of advantages in a retail environment.

FIG. 1 shows a display system 10 secured to a support structure 12, such as a wall or other stationary base fixture, such as an end cap or end of a display shelf, according to some embodiments. The display system 10 includes a base assembly 14, a support bar 16 and a signholder 18. The support bar 16 is largely obscured by the signholder 18 in FIG. 1, and is thus represented by dotted lines in FIG. 1. In order to provide additional understanding, a second support bar 16*a* is shown in solid lines to the right of the support bar 16 without an associated signholder. In general terms, and as will be subsequently described, the signholder 18 is secured to the support bar 16. The support bar 16, in turn, is releasably secured to the base assembly 14 in order to hang the signholder 18 from the base assembly 14.

Using bolts or other fasteners, the base assembly 14, also described as a support assembly, is optionally secured to the support structure 12. The support structure 12 is optionally a shelf in a retail environment, such as a store, although other environments, such as storage or home environments, are also contemplated. The base assembly 14 includes a first upright 20, a second upright 22, a third upright 24, one or more product fixtures 26 maintaining one or more products 28, and a top fixture system 30.

The first upright 20, also described as a substantially vertical standard or a standard, is substantially elongate in shape and is optionally formed as a hollow, tubular bar having a first plurality of holes 32 formed along a length of the first upright 20. The first upright 20 is formed of metal, plastic, or other suitable material and is optionally substantially square in cross-section, substantially U-shaped in cross-section, or is otherwise suitably shaped. Each of the first plurality of holes 32 is optionally substantially rectangular, square, oval, or circular, for example. As will be described in greater detail, each of the first plurality of holes 32 defines an attachment site, or attachment point, for the support bar 16.

The second and third uprights 22, 24 are optionally substantially similar to the first upright 20, and as such can be described cumulatively with reference to the first upright 20. The second and third uprights 22, 24 accordingly have a second plurality of holes 34 and a third plurality of holes 36, respectively, laterally offset and generally corresponding in height to the first plurality of holes 32.

The one or more product fixtures 26 are adapted to be releasably secured to the first and second uprights 20, 22 and/or the second and third uprights 22, 24. The one or more products 28 are selected from a variety of items, including merchandise on display, such as clothing on hangers or shelves—women's undergarments, for example.

The top fixture system 30 is adapted to be releasably secured to the first, second, and third uprights 20, 22, 24. The top fixture system 30 provides attachment sites for hanging visual displays (not shown), for example, such as posters, signs, or other objects. In particular, wires or other fasteners are optionally secured to the top fixture system 30 to hang a particular visual display.

Construction of the base assembly 14 includes securing each of the first, second, and third uprights 20, 22, 24 in a substantially vertical orientation. The first, second, and third uprights 20, 22, 24 are optionally secured to the support structure 12, a shelf or wall or other appropriate support as desired. The first, second, and third uprights 20, 22, 24 are laterally spaced from one another and are substantially parallel. As alluded to above, the first, second, and third pluralities of holes 32, 34, 36 of the first, second, and third uprights 20, 22, 24, respectively, are laterally aligned, corresponding in height to define corresponding lateral sets of attachment sites. The product fixture 26 maintaining the products 28 is secured between the first and second uprights 20, 22 at one or more lateral sets of attachment points. In turn, the top fixture system 30 is releasably secured to the first, second, and third uprights 20, 22, 24.

Figure 2:
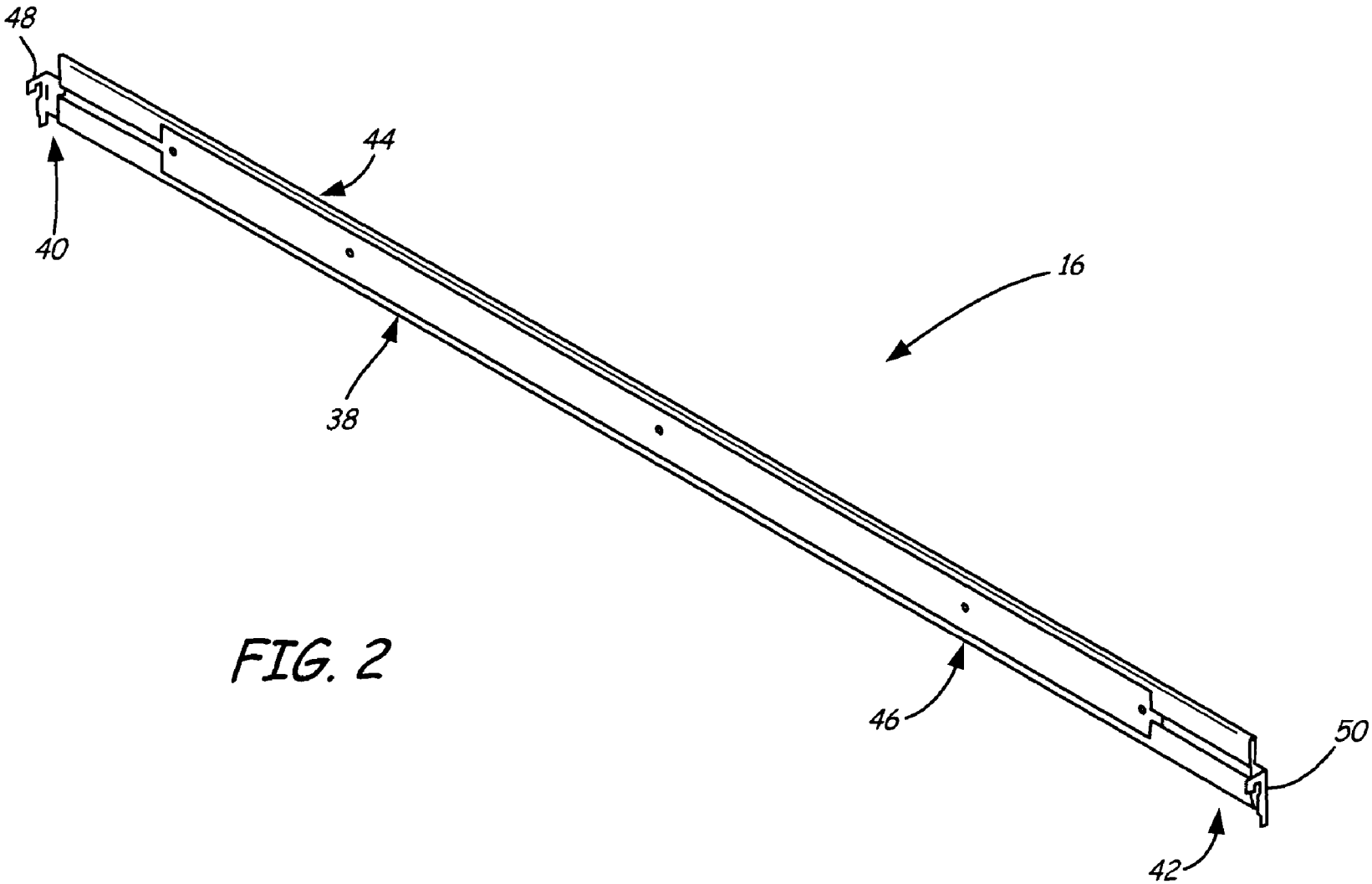
FIG. 2 is a rear perspective view of a support bar of the display system of FIG. 1, according to some embodiments.

FIG. 2 shows a perspective view of the support bar 16, also described as a member. The support bar 16 includes a body 38, also defined as an elongate body or an extended portion, having a first end 40, a second end 42, a top edge 44, a bottom edge 46. The support bar 16 also includes a first bracket 48 and a second bracket 50. The body 38 is optionally substantially rectangular in front profile. As will be described in greater detail below, the first and second brackets 48, 50 are each telescopically, or substantially horizontally, as well as substantially vertically adjustable relative to the body 38 to facilitate use of the support bar 16 with various types and arrangements of uprights that define sets of attachment points having different lateral and substantially vertical offsets. Optionally, one of the first and second brackets 48, 50 is rigidly secured to the body 38, for example being substantially continuously formed with the body 38, welded to the body 38 or otherwise secured relative to the body 38. The support bar 16 is optionally formed of metal, plastic, or other suitable material.

Figure 3A:
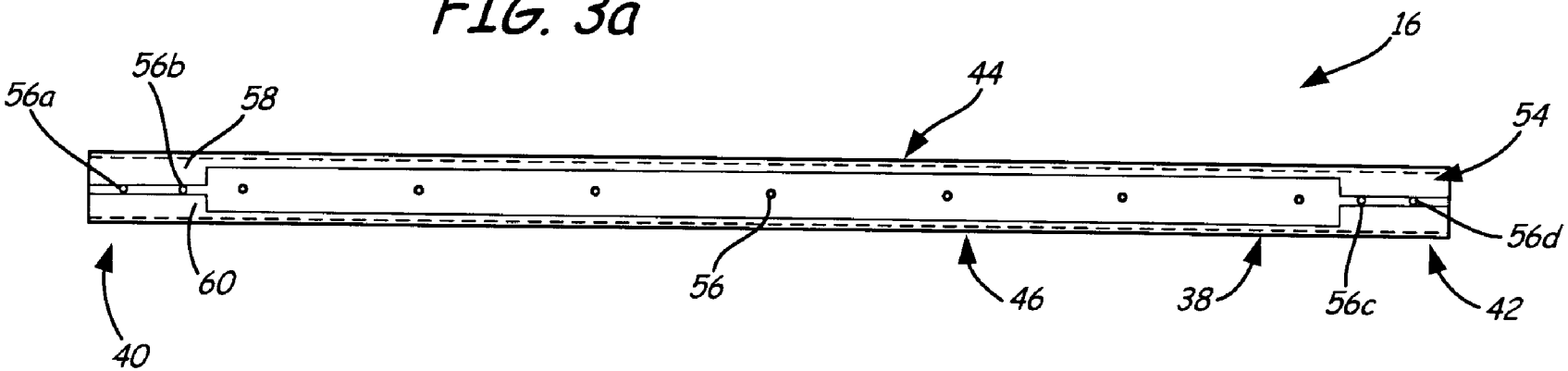
FIG. 3*a* is a rear view of a body of a support bar of FIG. 2, according to some embodiments.
Figure 3B:
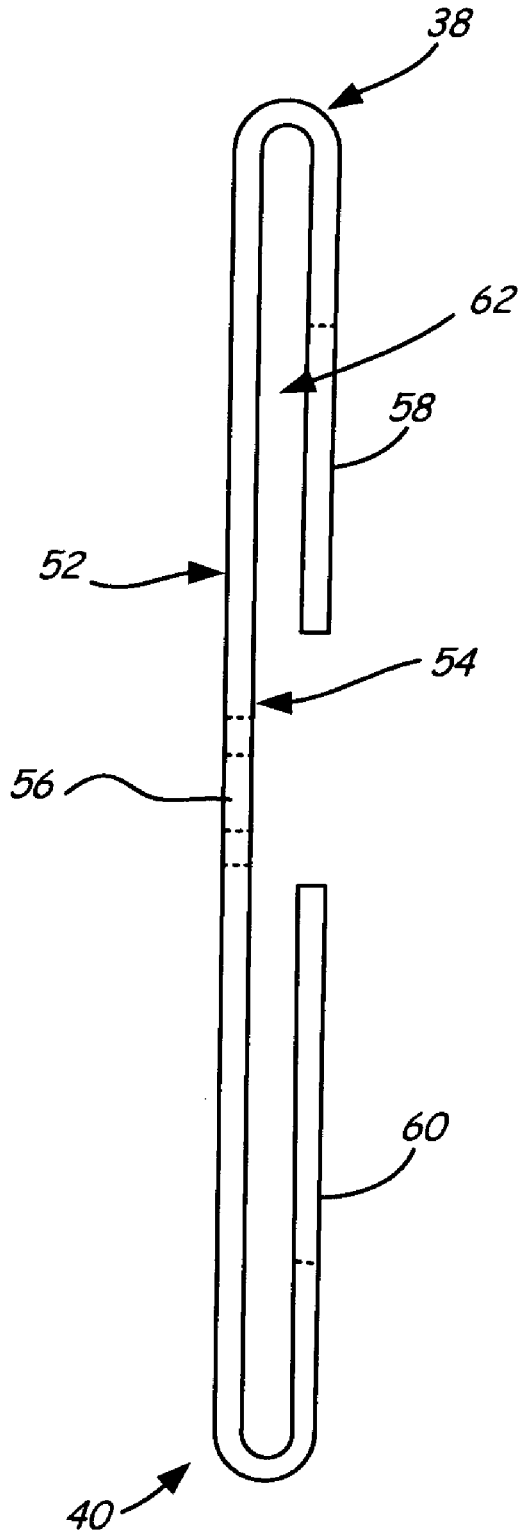
FIG. 3*b* is a side view of the body of the support bar of FIG. 3*a*, according to some embodiments.

FIG. 3*a* shows a rear view of the body 38 and FIG. 3*b* shows a side view from the first end 40 of the body 38. With reference to FIGS. 3*a* and 3*b*, the body 38 defines a front face 52, a rear face 54 and a plurality of holes 56 disposed between the first end 40 and the second end 42. The top and bottom edges 44, 46 of the body 38 are folded back rearwardly from the front face 52 toward the rear face 54 to form a top lip 58 and a bottom lip 60, respectively. The top and bottom lips 58, 60 (shown in dashed lines in FIG. 3*a*) are formed such that the top and bottom lips 58, 60 are substantially parallel with the rear face 54. The top and bottom lips 58, 60 together with the rear face 54 define a channel member 62, or track, extending along at least a portion of the body 38. Optionally, the top and bottom lips 58, 60 extend from the top edge 44 and the bottom edge 46, respectively, at varying distances along the length of the body 38, as can be seen in the embodiment shown in FIG. 3*a*. The first bracket 48, the second bracket 50 and the channel member 62 together form a channel assembly 64 (shown in FIG. 6) for mounting the support bar 16, and adjusting the support bar 16 relative to, the first and second substantially vertical uprights 20, 22 (shown in FIG. 1). In some embodiments (not shown), the channel member 62 has a first portion extending from the first end 40 and a separate, second portion extending from the second end 42.

The plurality of holes 56 are disposed lengthwise along the body 38. Each of the holes 56 is adapted to receive a pin 66 for releasably or non-releasably securing the signholder 18 (shown in FIG. 1) to the body 38 of the support bar 16. At least a first hole 56*a* and a second hole 56*b* reside proximate the first end 40 of the body 38 and a third hole 56*c* and a fourth hole 56*d* reside proximate the second end 42 of the body 38. The first and second holes 56*a*, 56*b*, in combination with a first pin 66*a* and a second pin 66*b* (shown in FIG. 7*a*), assist in adjustably securing the first bracket 48 to the body 38. Likewise, the third and fourth holes 56*c*, 56*d*, in combination with a third pin 66*c* and a fourth pin 66*d* (shown in FIG. 7*a*), assist in adjustably securing the second bracket 50 to the body 38. Thus, in addition to securing the support bar 16 to the signholder 18, the first, second, third, and fourth holes 56*a*-

56*d* and first, second, third, and fourth pins 66*a*-66*d* also allow the support bar 16 to be adjusted with respect to the signholder 18. Examples of suitable pins include, but are not limited to: rivets, plastic clips, plastic bolts, wires or other fasteners.

The body 38 is about 46 inches long, about 2.35 inches tall and about 1.58 inches thick overall (including extension of the lips 58, 60), although other dimensions are contemplated. The channel member 62 has a depth of about 0.78 inches, although other dimensions are contemplated. Each of the plurality of holes 56 is about 0.25 inches in diameter and is spaced from an adjacent hole 56 by about 6 inches, although other dimensions are contemplated. Holes 56*a*-56*d* are positioned closer than the remainder of the holes 56 in order to be located proximate first and second ends 40, 42 of the body 38, respectively.

Figure 4A:
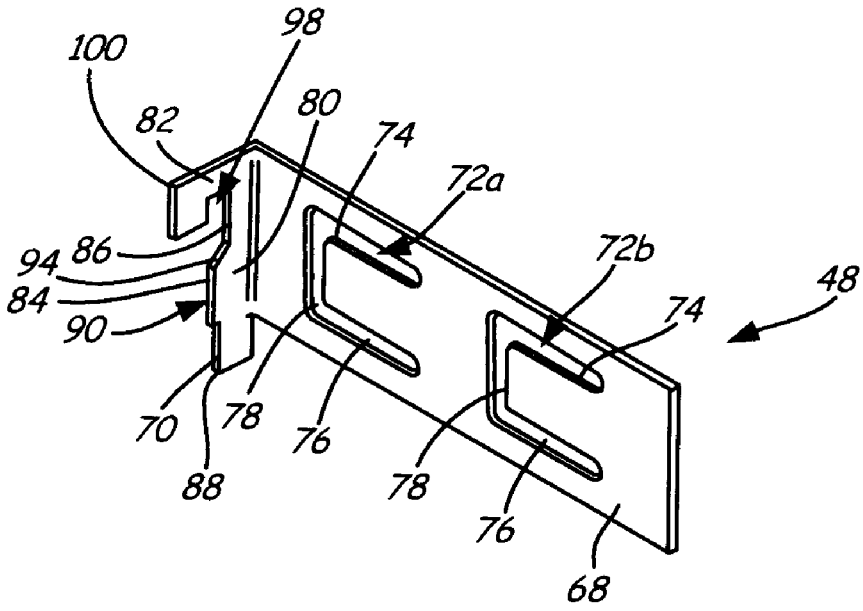
FIG. 4*a* is a rear perspective view of a first bracket of the support bar of FIG. 2, according to some embodiments.
Figure 4B:
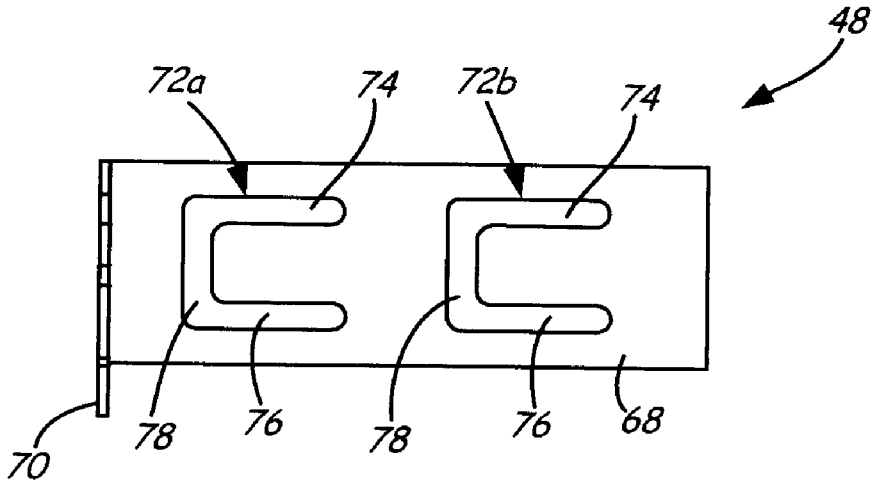
FIG. 4*b* is a rear view of the first bracket of FIG. 4*a*, according to some embodiments.
Figure 4C:
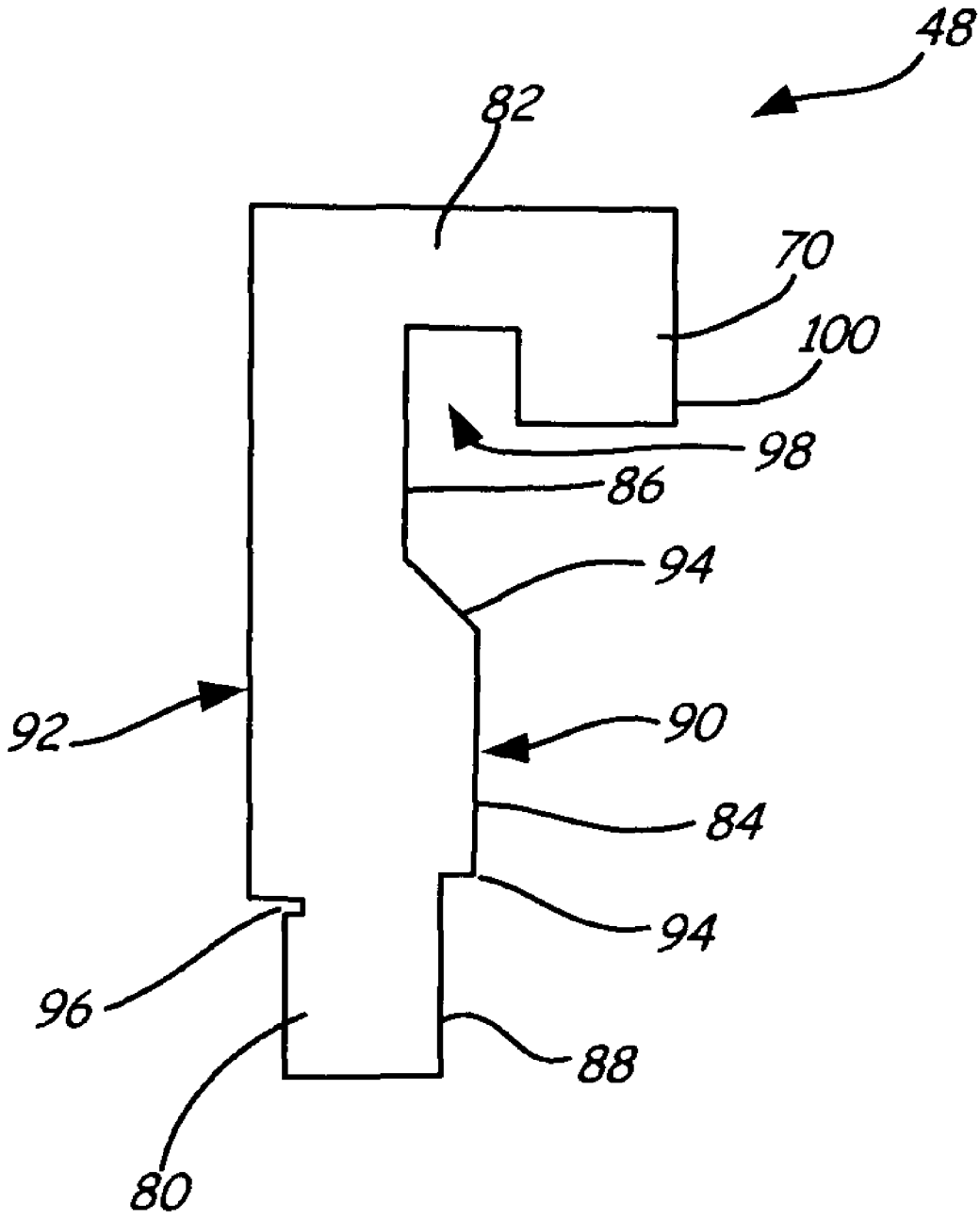
FIG. 4*c* is a side view of the first bracket of FIGS. 4*a* and 4*b*, according to some embodiments.

FIGS. 4*a*, 4*b* and 4*c* show a rear perspective view, a rear view and a side view, respectively, of the first bracket 48. The first bracket 48 provides part of the means for releasably securing the support bar 16 to the first upright 20 (shown in FIG. 1). With reference to FIGS. 4*a*-4*c*, the first bracket 48 includes an insert arm 68 and a tab 70. The insert arm 68, also described as a slide arm or slide portion, is formed as a thin, elongate piece sized and shaped for insertion into the channel member 62 at the first end 40 of the body 38 (shown in FIGS. 3*a* and 3*b*). The insert arm 68 defines a first C-shaped slot 72*a* and a second C-shaped slot 72*b* (collectively referred to as "slots 72"). Each of the slots 72*a* and 72*b* has a substantially horizontal, upper portion 74, a substantially horizontal, lower portion 76 and a substantially vertical portion 78 connecting the upper and a substantially horizontal, lower portions 74, 76. The substantially horizontal portions 74, 76 and the substantially vertical portions 78 are adapted to work in conjunction with the first and second pins 66*a*, 66*b* (shown in FIG. 7*a*) to allow the first bracket 48 to slide in and out, or telescope, as well as up and down within the channel member 62 (shown in FIG. 3*b*) while limiting the amount of substantially lateral and substantially vertical movement of the first bracket 48 within the channel member 62. The overall length of the support bar 16 is adjusted by positioning the first bracket 48 at varying positions within the channel member 62 such that the tab 70 of the insert arm 68 is located at varying distances relative to the first end 40 of the body 38 (shown in FIGS. 3*a* and 3*b*). The substantially vertical portion 78 of the slots 72 provides means for adjusting the position of the first bracket 48 within the channel member 62 such that the first bracket 48 is positionable at varying heights relative to the top edge 44 and the bottom edge 46 of the support bar 16.

The tab 70, also described as a tooth or tooth portion, is a thin piece protruding substantially orthogonally from the insert arm 68 designed for use with multiple types of slots/mounting standards. The tab 70 is optionally formed continuously with the insert arm 68 or is otherwise secured thereto. With particular reference to FIG. 4*c*, the tab 70 has an inverted J-shape defined by a substantially vertical portion 80 and a hook portion 82. The substantially vertical portion 80 has includes a base 84, a neck 86 and a toe 88. The base 84 has a front edge 90 and a back edge 92. The neck 86 extends fluidly into the hook portion 82. In turn, the base 84 extends between the neck 86 and the toe 88 where the base 84 tapers down in width into the neck 86 with the front edge 90 defining a taper 94. The base 84 steps down in width at the toe 88 with the back edge 92 defining a bend relief 96. The bend relief 96 makes the tab 70 easier to produce by eliminating burrs and sharp points and by reducing stress fracture propagation so that the tab 70 does not tear when being formed. The hook portion 82 defines a mouth 98 and curves toward itself to form a catch 100. As will be described in greater detail, the tab 70 is adapted to be inserted, hook portion 82 first, into one of the pluralities of holes 32, 34 associated with the first and second uprights 20, 22, respectively, and then slid downward to releasably secure the first bracket 48 to one of the first and second uprights 20, 22.

The insert arm 68 is about 4.16 inches long and about 1.44 inches tall, the substantially horizontal portions 74, 76 of the slots 72 are about 1.09 inches long (defining a lateral travel limit of about 1.09 inches for the first bracket 48), and the substantially vertical portion 78 of the slots 72 is about 0.94 inches tall (defining a substantially vertical travel limit of about 0.94 inches for the first bracket 48), although other dimensions are contemplated. The tab 70 is about 0.81 inches long and about 1.812 inches tall with the substantially vertical portion 80 being about 0.44 inches long including the taper 94, which is angled at about 46 degrees, and the hook portion 82 being about 0.81 inches long and about 0.25 inches tall, although other dimensions are contemplated.

Figure 5A:
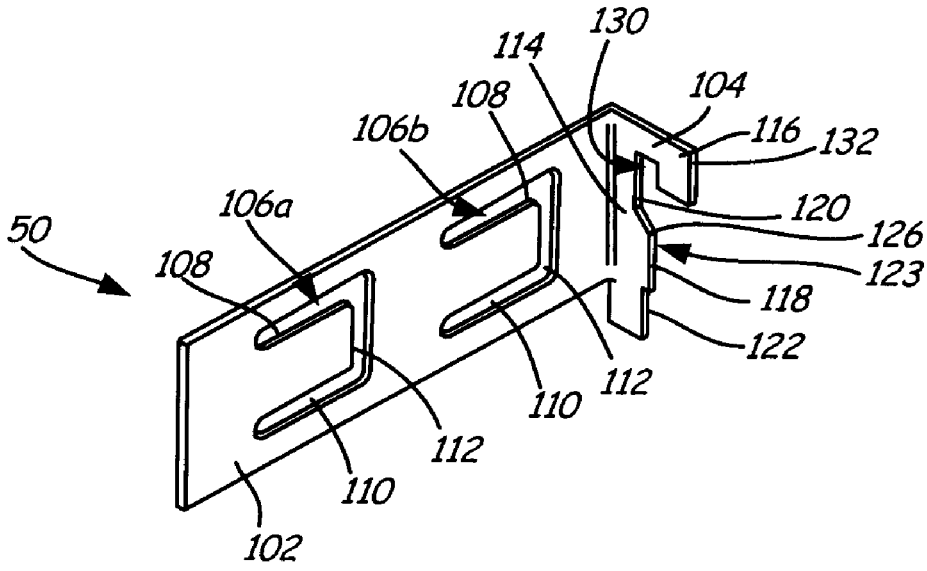
FIG. 5*a* is a rear perspective view of a second bracket of the support bar of FIG. 2, according to some embodiments.
Figure 5B:
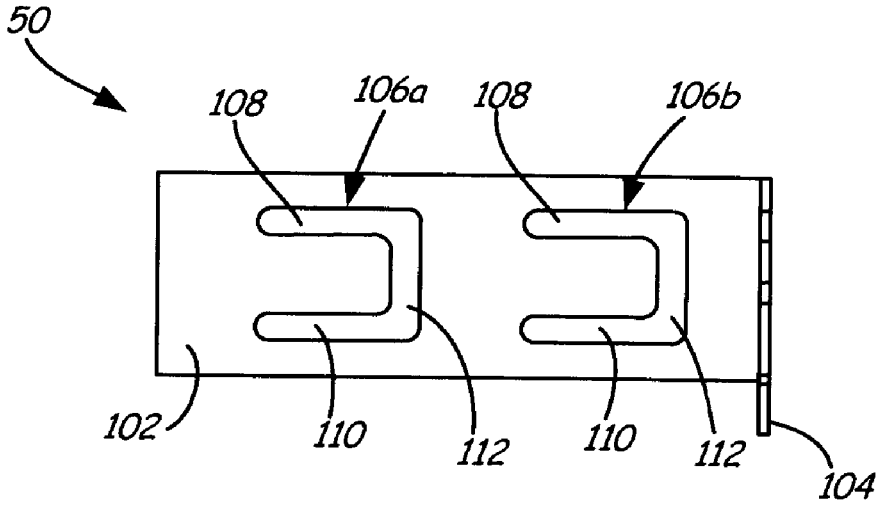
FIG. 5*b* is a rear view of the second bracket of FIG. 5*a*, according to some embodiments.
Figure 5C:
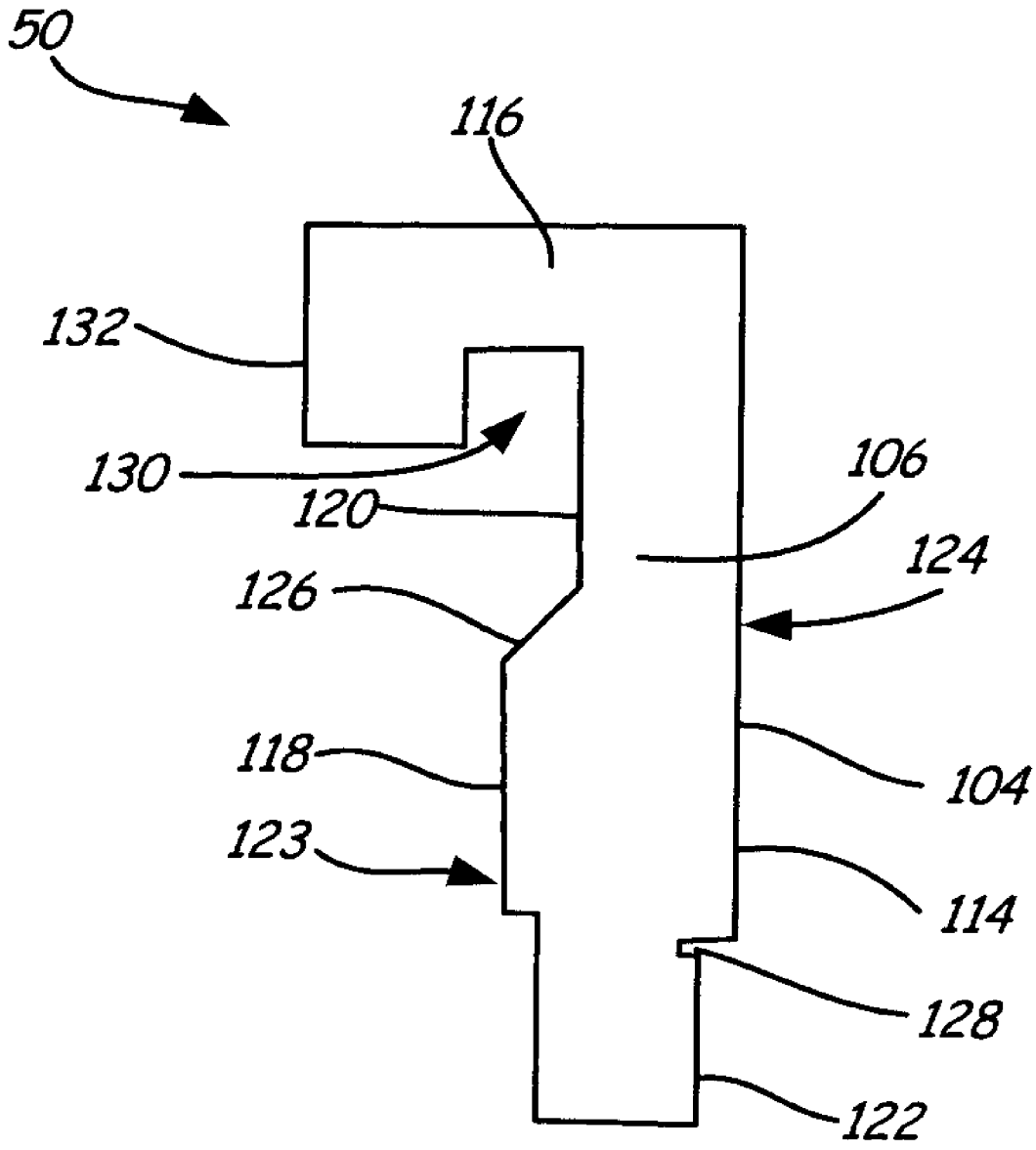
FIG. 5*c* is a side view of the second bracket of FIGS. 5*a* and 5*b*, according to some embodiments.

FIG. 5*a* shows a rear perspective view of the second bracket 50, FIG. 5*b* shows a rear view of the second bracket 50 and FIG. 5*c* shows a side view of the second bracket 50. FIGS. 5*a*, 5*b*, and 5*c* will be discussed in conjunction with one another. The second bracket 50 is substantially a mirror-image of the first bracket 48 (shown in FIGS. 4*a*-4*c*) and provides part of the means for releasably securing the support bar 16 to the second upright 22 (shown in FIG. 1). The second bracket 50 includes an insert arm 102 and a tab 104. The insert arm 102 is insertable into the channel member 62 at the second end 42 of the body 38 of the support bar 16 (shown in FIGS. 3*a* and 3*b*) and also defines a first C-shaped slot 106*a* and a second C-shaped slot 106*b* (collectively referred to "slots 106"), each having a substantially horizontal, upper portion 108, a substantially horizontal, lower portion 110, and a substantially vertical portion 112.

The tab 104 has a substantially vertical portion 114 and a hook portion 116. The substantially vertical portion 114 includes a base 118, a neck 120 and a toe 122. The base 118 includes a front edge 123 and a back edge 124. The front edge 123 defines a taper 126. The back edge 124 defines a bend relief 128. The hook portion 116 defines a mouth 130 and a catch 132. Each of the features of the insert arm 102 and the tab 104 are connected and function in a similar manner as the insert arm 68 and the tab 70 of the first bracket 48. The insert arm 102 and the tab 104 of the second bracket 50 thus also have similar dimensions as the insert arm 68 and the tab 70 of the first bracket 48. As will be described in greater detail, the tab 104 is adapted to be inserted, hook portion 116 first, into one of the pluralities of holes 34, 36 associated with the second and third uprights 22, 24, respectively, and then moved downward to releasably secure the second bracket 50 to one of the second and third uprights 22, 24.

Figure 6A:
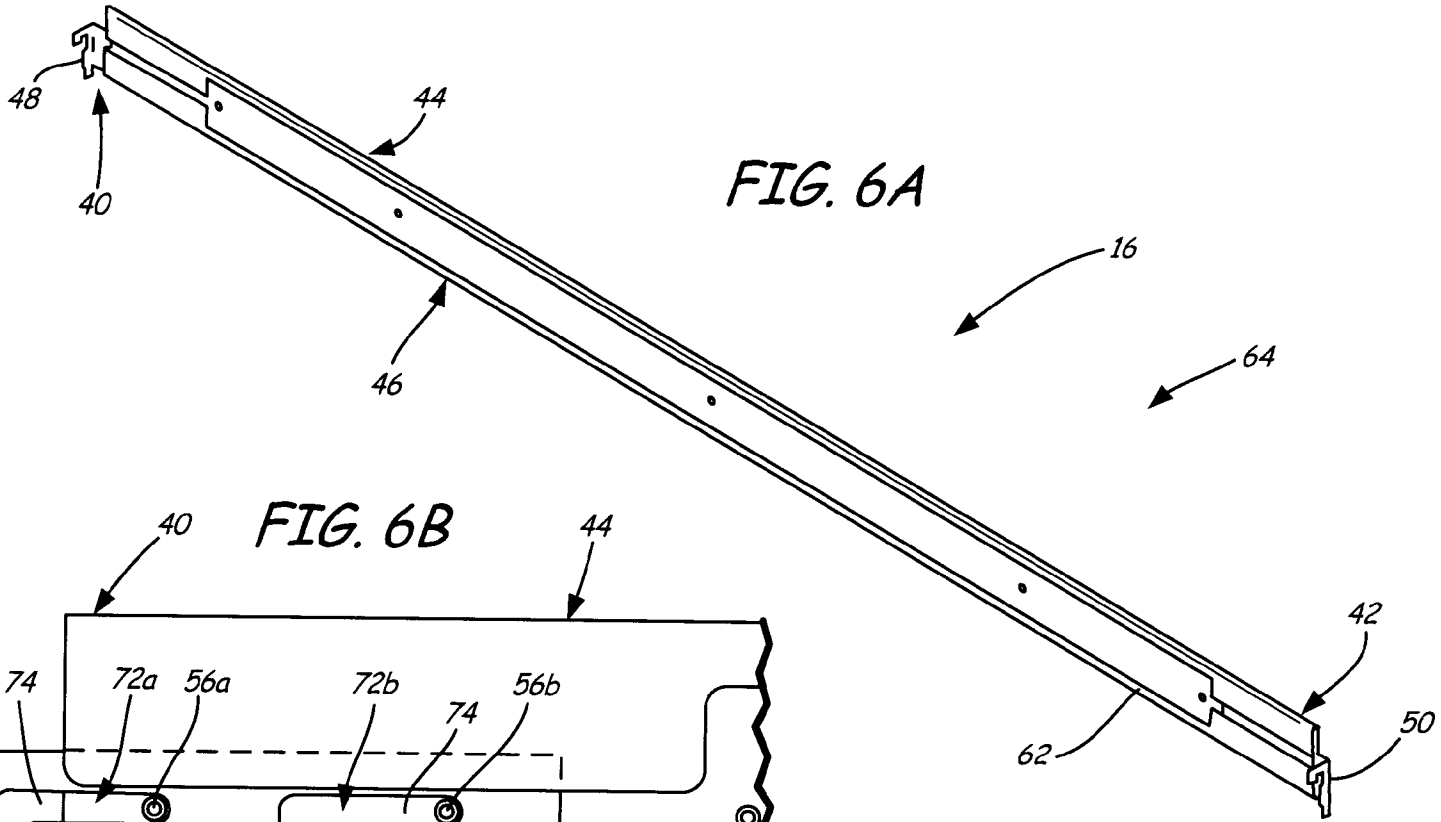
FIG. 6*a* is a rear perspective view of the support bar of FIG. 2, according to some embodiments.
Figure 6B:
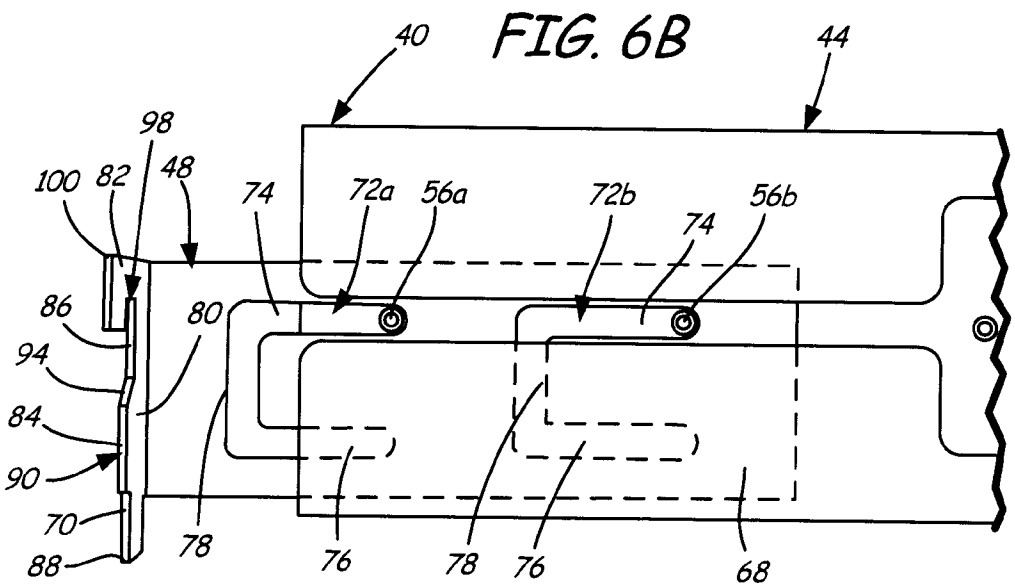
FIG. 6*b* is an enlarged partial perspective view of the support bar of FIG. 6*a*, according to some embodiments.

FIG. 6*a* shows a rear perspective view of the first and second brackets 48, 50 positioned within the channel member 62 of the support bar 16. FIG. 6*b* shows an enlarged partial perspective view of the first bracket 48 (shown partially in phantom) positioned within the channel member 62. The second bracket 50 is optionally mounted within the channel member 62 substantially similarly to the first bracket 48 and as such can be described cumulatively with reference to the first bracket 48. The first bracket 48 is slidably received in the channel member 62 such that the first bracket 48 can be adjusted in both a substantially vertical direction and a lateral direction. The two U-shaped slots 72*a* and 72*b* of the first bracket 48 ride on pins 66*a* and 66*b* in the channel member 62 and can be adjusted substantially vertically and/or substantially horizontally to attach the support bar 16 and the signholder 18 (shown in FIG. 1) to a variety of wall mounts. As previously mentioned, the tabs 70 and 104 of the brackets 48 and 50 are also versatile and designed to be insertable into multiple types of slots and mounting standards.

FIGS. 7*a*-7*d* show rear views of the support bar 16 with the first and second brackets 48 and 50 (shown partially in phantom) at varying (substantially horizontal and substantially vertical) positions within the channel member 62 of the support bar 16. The slots 72 and 106 are also shown in phantom. In some embodiments, a method of displaying a sign includes releasably attaching a channel assembly 64, including the channel member 62, the first bracket 48 and the second bracket 50 to a retail accessory, adjusting an overall length of the channel assembly 64 to correspond to a distance between a first attachment site defined by the first upright 20 and a second attachment site defined by the second standard 22, adjusting an overall height of the first bracket 48 and the second bracket 50 relative to the channel member 62, and releasably securing the channel assembly 64 to the first and second attachment sites to hang the signholder 18 in a substantially upright position from the first and second standards 20, 22.

Figure 7A:
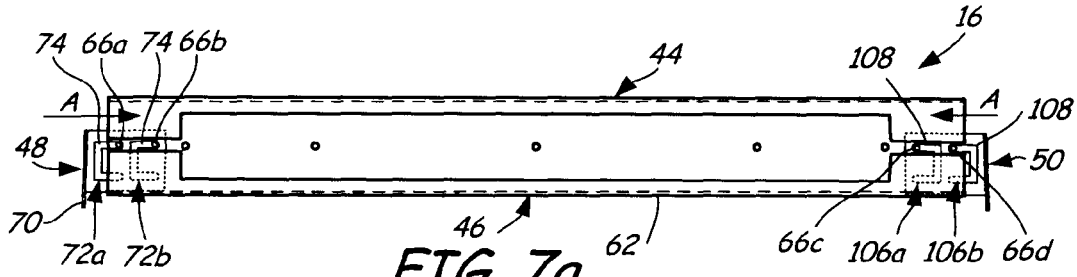
FIG. 7*a* is a rear view of the support bar of FIG. 6 with the first and second brackets (shown partially in phantom) in a first position, according to some embodiments.
Figure 7B:
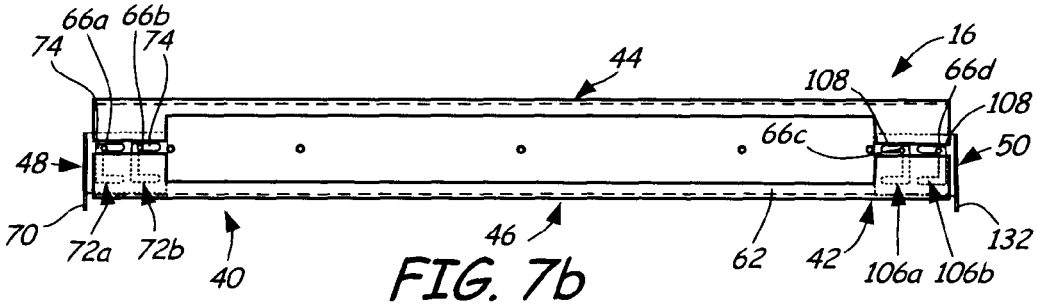
FIG. 7*b* is a rear view of the support bar of FIG. 6 with the first and second brackets (shown partially in phantom) in a second position, according to some embodiments.

The first and second brackets 48, 50 allow the overall length of the support bar 16 to be adjusted as desired to correspond to the lateral distance between the first and second target holes 32*a*, 34*a* of the first and second uprights 20, 22, respectively (shown in FIG. 1). For example, the first bracket 48 is optionally telescoped from a first position to a second position within the channel member 62, as shown in FIGS. 7*a* and 7*b*, to adjust the support bar 16 to the desired length. FIG. 7*a* shows the first bracket 48 in the first position with the first and second pins 66*a*, 66*b* positioned to one side of the substantially horizontal, upper portions 74 of the slots 72. To shorten the overall length of the support bar 16, the first bracket 48 is guided by the first and second pins 66*a*, 66*b* in the substantially horizontal, upper portions 74 of the slots 72 in the substantially horizontal direction of arrow A to the second position. As shown in FIG. 7*b*, in this second position, the tab 70 of the first bracket 48 is brought closer to the first end 40 of the support bar 16, reducing the overall length of the support bar 16. The first bracket 48 is adjustable to any distance within the channel member 62 between the first and second positions shown FIGS. 7*a* and 7*b*, respectively. The length of the support bar 16 may also be adjusted by telescoping the second bracket 50 within the channel member 62 in a similar manner.

Figure 7C:
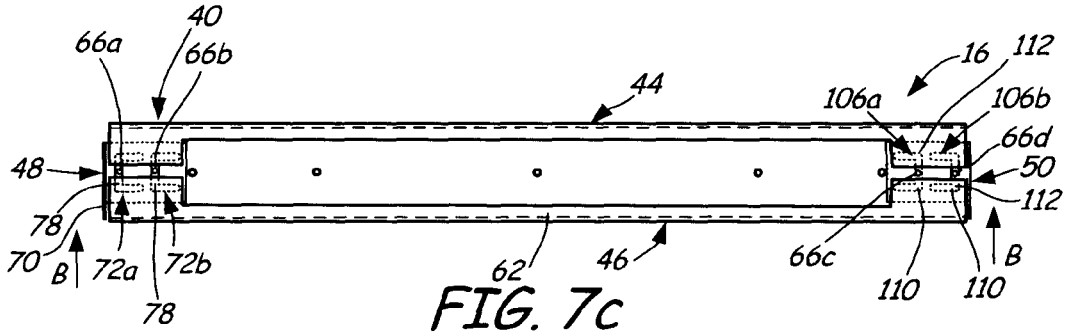
FIG. 7*c* is a rear view of the support bar of FIG. 6 with the first and second brackets (shown partially in phantom) in a third position, according to some embodiments.
Figure 7D:
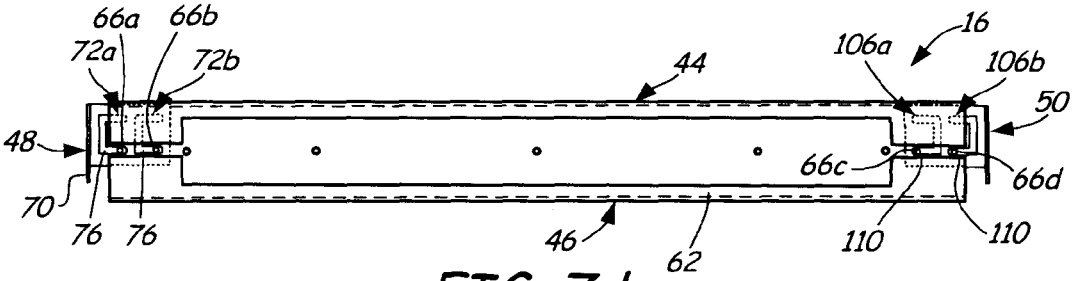
FIG. 7*d* is a rear view of the support bar of FIG. 6 with the first and second brackets (shown partially in phantom) in a fourth position, according to some embodiments.

The first and second brackets 48, 50 also allow the overall height of the support bar 16 to be adjusted to correspond to a desired substantially vertical distance from the top edge 44 and the bottom edge 46 of the support bar 16, respectively. For example, the first bracket 48 is optionally adjusted from the second position (shown in FIG. 7*b*) to a third position (shown in FIG. 7*d*) to adjust the position of the first bracket 48 with respect to the top edge 44 of the support bar 16. To move the first bracket 48 from the second position to the third position, the first bracket 48 is positioned such that the first and second pins 66*a*, 66*b* are positioned in the substantially vertical portions 78 of the slots 72 (FIG. 7*c*). The first bracket 48 is then guided in a upwardly, substantially vertical direction, as shown by arrow B in FIG. 7*c*, such that the first bracket 48 is brought closer to the top edge 44 of the support bar 16. The first bracket 48 is moved such that the first and second pins 66*a*, 66*b* are positioned in the substantially horizontal, lower portions 76 of the slots 72 and the first bracket 48 is moved at least slightly toward the center of the support bar 16 such that the first and second pins 66*a*, 66*b* are positioned within the substantially horizontal, lower portions 76, as shown in FIG. 7*d*. The first bracket 48 is moved toward the center of the support bar to ensure that the first and second pins 66*a*, 66*b* are not inadvertently projected downward in the substantially vertical portions 76 if pressure is applied to the first bracket 48. In some embodiments, the first bracket 48 is adjustable to the two heights given by positioning the first and second pins 66*a*, 66*b* either at the substantially horizontal, upper portions 74 or at the substantially horizontal, lower portions 76 of the slots 72. The second bracket 50 is also adjusted within the channel member 62 in a similar manner.

Figure 8A:
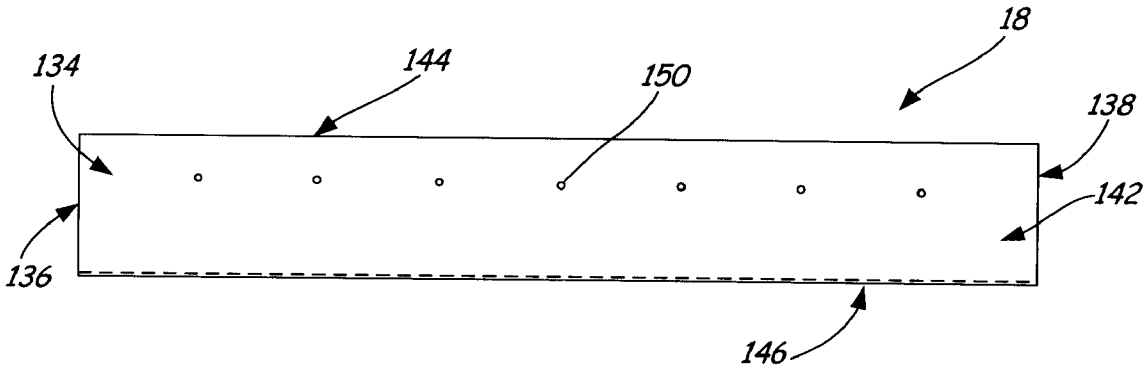
FIG. 8*a* is a rear view of the signholder of the display system of FIG. 1, according to some embodiments.
Figure 8B:
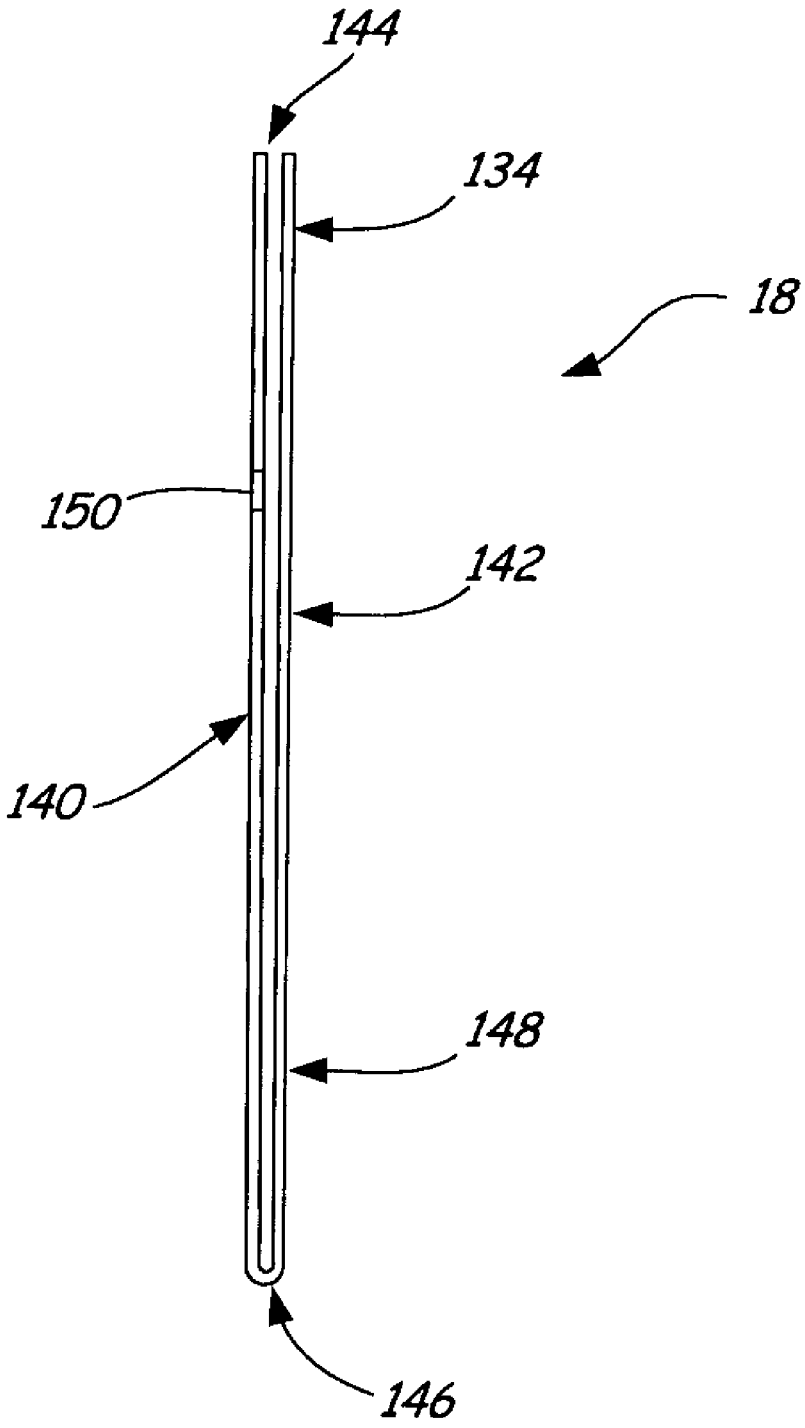
FIG. 8*b* is a side view of the signholder of FIG. 8*a*, according to some embodiments.

FIGS. 8*a* and 8*b* show a rear view and a side view, respectively, of the signholder 18. FIGS. 8*a* and 8*b* will be discussed in conjunction with one another. The signholder 18, also defined as a plastic sheath, casing or other retail assembly, includes a body 134 having a first end 136, a second end 138, a front face 140, a rear face 142, a top edge 144 and a bottom edge 146. The front face 140, rear face 142 and bottom edge 146 of the body 134 form a U-shaped housing 148. The U-shaped housing 148 is designed to slidably receive a sign insert. At least the front face 140 of the signholder 18 is formed from a substantially transparent material, such as, for example, plastic or other suitable material. Because the signholder 18 is formed form a transparent material, when a sign insert or other substantially flat piece of material displaying a sign or piece of advertisement, is positioned within the housing 148, the piece of material positioned between the front and rear faces 140, 142 is viewable by a user standing in front of the signholder 18.

The front face 140 and the rear face 142 of the signholder 18 are substantially parallel and are connected at the bottom edge 146 to form the housing 148. The front face 140 and the rear face 142 are either formed by two separate pieces that are connected to each other at the bottom edge 146 or are optionally integral or otherwise connected with each other. In the case where the front and rear faces 140, 142 are integral, the body 134 is folded substantially in half until the front and rear faces 140, 142 are substantially parallel. The housing 148 is formed such that the signholder 18 is substantially U-shaped when viewed from the side (as shown in FIG. 8*c*). The signholder 18 is optionally substantially rectangular in front profile.

The body 134 includes a plurality of holes 150 disposed lengthwise along the rear face 142 of the signholder 18 between the first and second ends 136, 138. The holes 150 are adapted to receive pins 66 for releasably or non-releasably securing the signholder 18 to the body 38 of the support bar 16 (shown in FIG. 2). In order to facilitate assembly of the signholder 18 to the support bar 16, the holes 150 of the signholder 18 are disposed along the length of the body 134 of the signholder 18 such that adjacent holes 150 are spaced from each other at distances similar to adjacent holes 56 of the support bar 16.

The housing 148 is about 47.5 inches long and about 7.1 inches tall, although other dimensions are contemplated. Each of the plurality of holes 150 is about 0.156 inches in diameter and is spaced from an adjacent hole 150 by about 7 or 12 inches, although other dimensions are contemplated. The holes 150 are positioned about 2.06 inches from the top edge 144 of the signholder 18, although other dimensions are contemplated.

Figure 9:
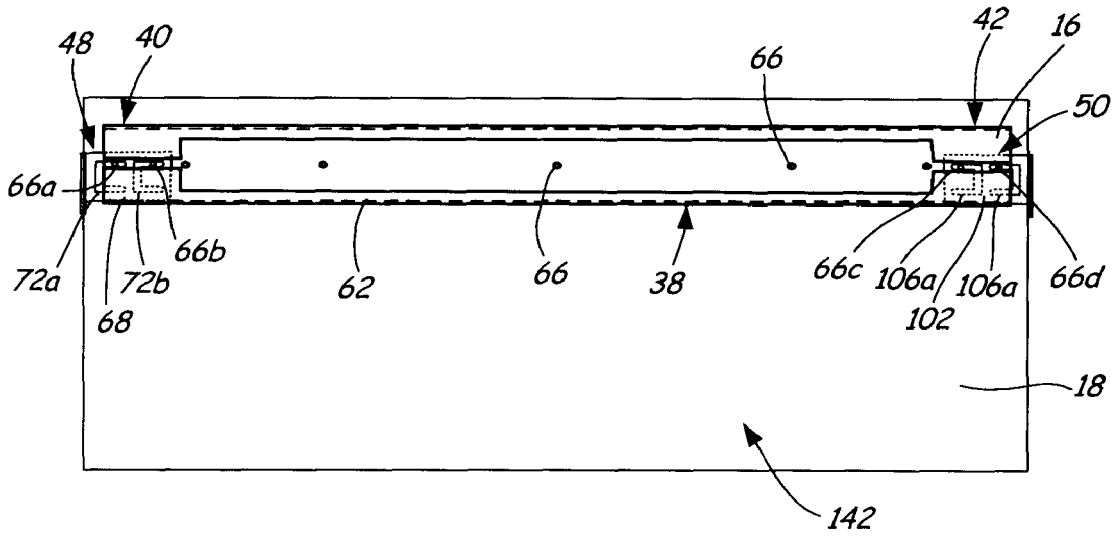
FIG. 9 is a rear view of the signholder secured to the support bar, according to some embodiments.

FIG. 9 is a rear view of the signholder 18 secured to the support bar 16. In some embodiments, assembly of the signholder 18 to the support bar 16 includes positioning the rear face 142 of the signholder 18 against the front face 52 (shown in FIG. 3*b*) of the support bar 16 and aligning the plurality of holes 56 (shown in FIG. 2) of the support bar 16 with the plurality of holes 150 (shown in FIG. 8*a*) of the signholder 18.

Pins 66 are then passed through the holes 56 of the support bar 16 and the holes 150 of the signholder 18 to secure the signholder 18 to the support bar 16. Next, the insert arms 68 and 102 of the first and second brackets 48, 50 are inserted into the channel member 62 of the body 38 at the first and second ends 40, 42, respectively. The first bracket 48, the support bar 16 and the signholder 18 are attached together by first and second pins 66*a*, 66*b*. The first pin 66*a* is fastened through the first slot 72*a* of the first bracket 48 and through the first hole 56*a* of the body 38 of the support bar 16. The first pin 66*a* optionally also passes through a hole 150 of the rear face 142 of the signholder 18. Similarly, the second pin 66*b* is fastened through the second slot 72*b* of the first bracket 48 and through the second hole 56*b* of the support bar 16. The second pin 66*b* optionally also passes through a hole 150 of the rear face 142 of the signholder 18. The second bracket 50, the support bar 16, and the signholder 18 are likewise attached together. The third pin 66*c* is fastened through the first slot 106*c* of the second bracket 50 and through the third hole 56*c* of the support bar 16. The third pin 66*c* optionally also passes through a hole 150 of the rear face 142 of the signholder 18. Similarly, the fourth fastener 66*d* is fastened through the second slot 106*b* of the second bracket 50 and through the fourth hole 56*d* of the support bar 16. The fourth pin 66*d* optionally also passes through a hole 150 of the rear face 142 of the signholder 18. Each of these configurations defines a pin-and-slot mechanism, or pin-and-slot relationship, limiting the inward and outward travel of the first and second brackets 48, 50 within the channel member 62 as well as the upward and downward travel of the first and second brackets 48, 50 within the channel member 62.

Figure 10A:
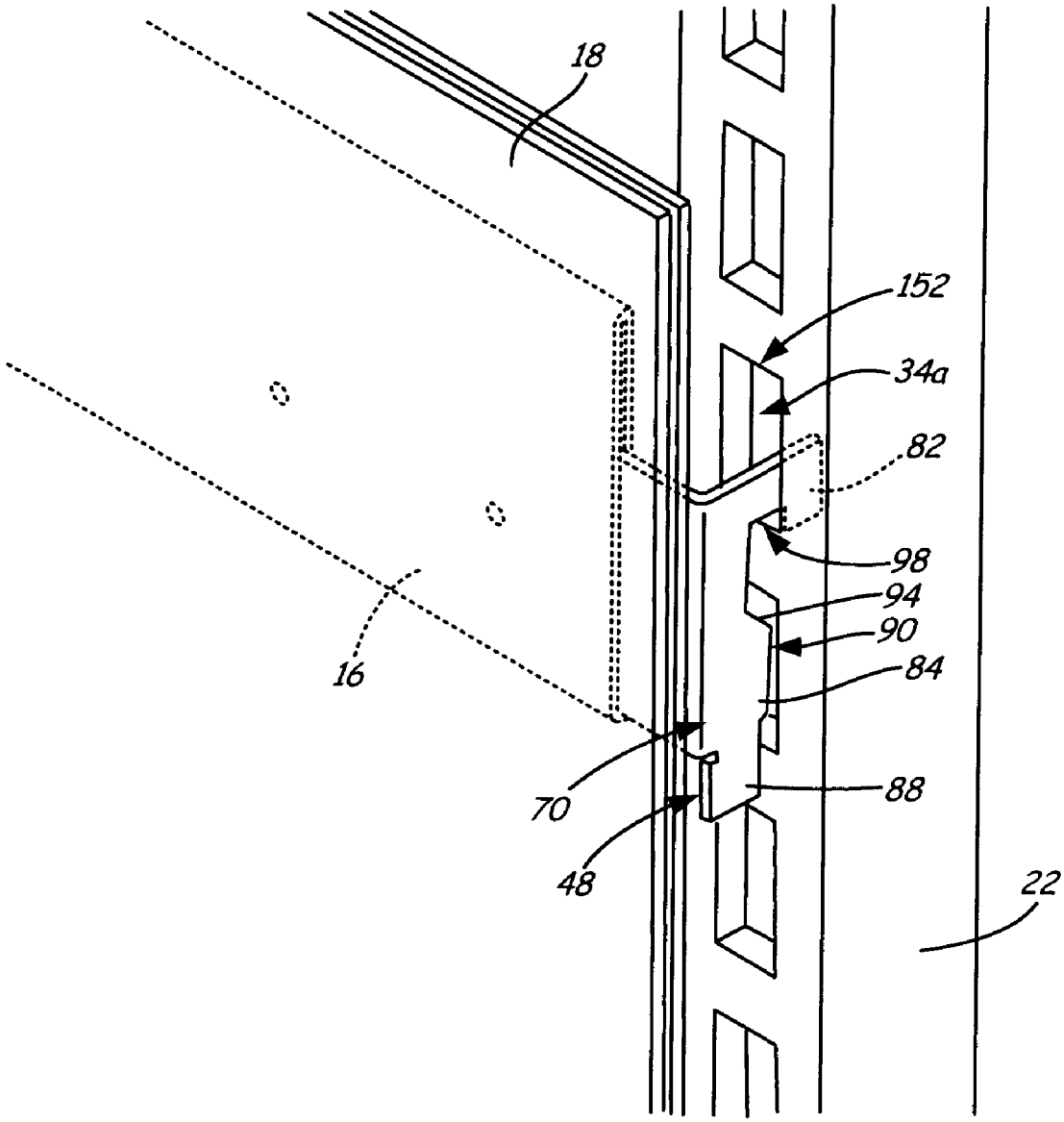
FIG. 10*a* is a cross-sectional view of the support bar of FIG. 2 assembled to an upright of the display system of FIG. 1, according to some embodiments.
Figure 10B:
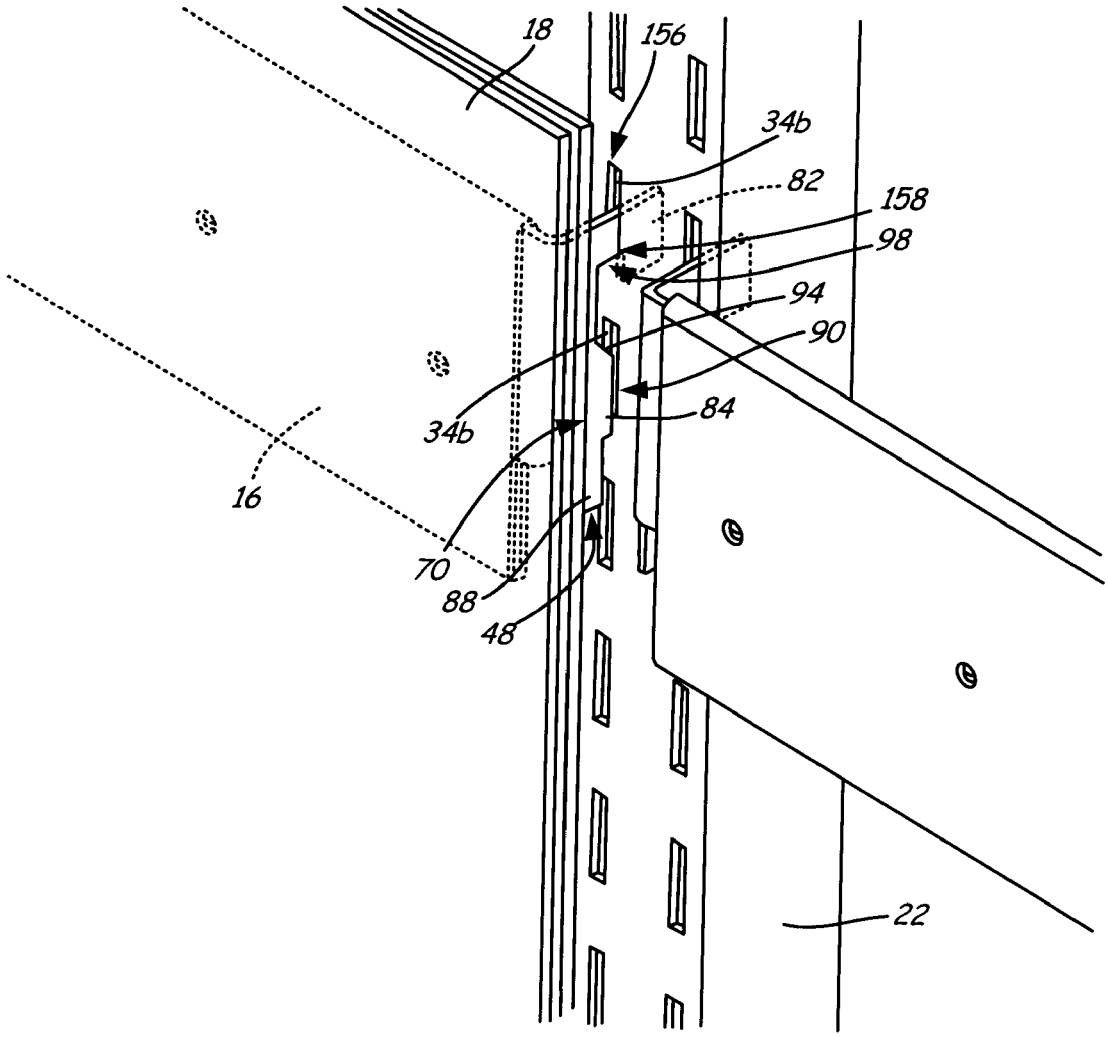
FIG. 10*b* is a cross-sectional view of the support bar of FIG. 2 assembled to an upright of the display system of FIG. 1, according to some embodiments.

With reference to FIGS. 1, 7*a*-7*d*, 10*a* and 10*b*, the support bar 16 is optionally assembled to the base assembly 14 using the first and second brackets 48, 50. FIG. 10*a* is a cross-sectional view of a portion of the support bar 16 assembled to a target hole 34*a* of the plurality of holes 34 of an embodiment of the second upright 22. FIG. 10*b* is a cross-sectional view of a portion of the support bar 16 assembled to a target hole 34*b* of the plurality of holes 34 of another embodiment of the second upright 22, according to some embodiments. For illustration purposes, the signholder 18 is not shown in FIGS. 10*a* and 10*b*, although it should be understood that the support bar 16 is optionally assembled to the base assembly 14 before assembly of the signholder 18 to the support bar 16. In other embodiments, the signholder 18 is assembled to the base assembly 14 after assembly of the signholder 18 to the support bar 16.

Assembly of the support bar 16 to the base assembly 14 includes adjusting the length of the support bar 16 and the height of the first and second brackets 48, 50 relative to a top edge 44 of the support bar 16. In particular, the length of the support bar 16 is adjusted such that the first and second brackets 48, 50 line up with target holes 32*a*, 34*a* of the pluralities of holes 32, 34 of the first and second uprights 20, 22, respectively. The heights of the first and second brackets 48, 50 are then adjusted relative to the top edge 44 of the support bar 16 based on the desired height of the signholder 18 with respect to the display system 10. In this manner, the support bar 16 allows for releasable fixation at a variety of upright spacings and also allows for some deviation in the spacing between the first and second uprights 20, 22.

Referring first to FIG. 10*a*, the target hole 34*a* of the second upright 22 is defined by a top edge of material 152 and a bottom edge of material 154. The method of assembling includes inserting the hook portion 82 of the first bracket 48 into the target hole 34*a*. The taper 94 of the front edge 90 optionally facilitates smooth insertion of the hook portion 82 into the target hole 34*a*. The taper 94 acts as a clearance such that when the first bracket 48 is being installed, the first bracket 48 will not interfere with the hole adjacent target hole 34*a*. The hook portion 116 of the second bracket 50 is similarly inserted into a target hole 32*a* (not shown). Following insertion of the hook portions 82, 116 into the target holes 34*a*, 32*a*, respectively, the support bar 16, including the first and second brackets 48, 50, is moved downward. Once the first bracket 48 is moved downward, the hook portion 82 rests against the bottom edge of material 154 of the second upright 22 and the bottom edge of material 154 is received in the mouth 98 of the hook portion 82. The mouth 98 of the hook portion 82 acts to releasably retain the first bracket 48 in the target hole 34*a*. As can be seen in FIG. 10*a*, when the first bracket 48 is positioned in the target hole 34*a*, the toe 88 abuts the second upright 22 to maintain the signholder 18 in a substantially vertical position. If the toe 88 did not abut the second upright 22, the tab 70 would continue to move in a rearward direction, causing the signholder 18 to tilt relative to the first and second uprights 20, 22. The second bracket 50 is similarly inserted into and moved downward within the target hole 32*a* of the first upright 20*a* to releasably retain the second bracket 50 to an attachment site defined by the target hole 32*a* of the first upright 20. It should be understood that the support bar 16 can be used with target holes of different sizes as desired, as shown below with reference to FIG. 10*b*.

Referring now to FIG. 10*b*, the target hole 34*b* of the second upright 22 is defined by a top edge of material 156 and a bottom edge of material 158. The method of assembling is substantially similar to positioning the hook portion 82 of the first bracket 48 in the target hole 34*a* described above. However, because the target hole 34*a* has a shorter height such that an adjacent hole 34*b* is spaced closer to the target hole 34*a*, the tab 70 rests differently against the second upright 22. As can be seen in FIG. 10*b*, when the first bracket 48 is positioned in the target hole 34*a* such that the hook portion 82 rests against the bottom edge of material 158 of the second upright 22 and the bottom edge of material 158 is received in the mouth 98 of the hook portion 82, the base 84 abuts the second upright 22 to maintain the signholder 18 in a substantially vertical position. The second bracket 50 is similarly inserted into and moved downward within a target hole 32*b* (not shown) of the first upright 20 to releasably retain the second bracket 50 to an attachment site defined by the target hole 32*b* of the first upright 20.

With the assembly and arrangement described above, each of the first and second brackets 48, 50 provides means for releasably securing the support bar 16 to the base assembly 14. From the preceding description, it should be understood that the weight of the signholder 18 optionally assists with retaining the first and second brackets 48, 50 in the downward, secure position. When release of the first and second brackets 48, 50 is desired, the support bar 16 is slide or upwardly with the body 38 moving outwardly and away from the first and second uprights 20, 22. The hook portions 82, 116 are removed from the target holes 32*a*, 34*a*, respectively.

As alluded to above and depicted in FIG. 1, a method of displaying merchandise to an observer in an environment, such as a retail environment, includes securing the first upright 20 in a substantially vertical orientation to the support structure 12 and securing the second upright 22 in a substantially vertical orientation to the support structure 12. The product fixture 26 is releasably secured to the first and second uprights 20, 22 and maintains the products 28, clothing (also referred to as "softlines") for example, such that the products 28 hang in front of the support structure 12 off of a floor of a retail location, according to some embodiments.

In some embodiments, the support bar 16 (with the signholder 18 when previously assembled thereto) is positioned above the one or more product fixtures 26 and the one or more products 28. Each of the first and second brackets 48, 50 is secured to a lateral set of attachment sites corresponding to the first and second target holes 32*a*, 34*a*. This releasably secures the signholder 18 in a substantially vertical orientation from the base assembly 14 and above the one or more hanging products 28.

When securing the first and second brackets 48, 50 to the first and second target holes 32*a*, 34*a*, respectively, the overall length of the support bar 16 is adjusted as desired to correspond to the lateral distance between the first and second target holes 32*a*, 34*a* of the first and second uprights 20, 22, respectively. The overall height of the support bar 16 relative to target holes 32*a*, 34*a* is also adjusted to correspond to a desired substantially vertical distance between the signholder 18 and the product fixtures 26 and products 28. After the support bar 16 is positioned at the desired height relative to the first and second uprights 20, 22 by inserting the first and second brackets 48, 50 within the first and second target holes 32*a*, 34*a*, respectively, the support bar 16 may be further adjusted by adjusting the first and second brackets 48, 50. The first and second brackets 48, 50 allow the height of the support bar 16 to be fine tuned depending on the layout of the display system and adjacent support bars and product fixtures.

For reference, the support bar 16, signholder 18, instructions, a sign and appropriate pins 66 are optionally provided to a retail location as a kit of parts. The sign optionally includes indicia corresponding to the products 28 the display system 10 is advertising. If desired, a plurality of different signholders are provided with the kit of parts.

Various advantages are optionally accomplished through use of the display system 10. For example, the support bar 16, as well as the signholder 18, is optionally assembled to the base assembly 14 after the one or more product fixtures 26 and products 28 have been assembled to base assembly 14. This facilitates interchanging signs as desired and allows flexibility in the manner in which a product display is assembled. Furthermore, the signholder 18 is readily changed, mixed-and-matched, adjusted, or otherwise optimized to provide a pleasing display to an observer.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A display system comprising:

a housing having a front face and a rear face; and a support bar including:

an elongate body having a front face and a channel; and a first bracket secured within the channel of the elongate body, wherein the first bracket is adjustable relative to the housing in two substantially perpendicular directions;

wherein the rear face of the housing is secured to the front face of the support bar, and wherein the first bracket includes an insert arm and a tab, and wherein the insert arm includes at least one slot for receiving a fastener to adjustably secure the first bracket to the elongate body of the support bar.

2. The display system of claim 1, further comprising a second bracket secured within the channel of the elongate body.

3. The display system of claim 2, wherein the first bracket is secured at a first end of the elongate body and the second bracket is secured at a second end of the elongate body.

4. The display system of claim 2, wherein the second bracket is adjustable in two substantially perpendicular directions.

5. The display system of claim 1, wherein the housing is substantially transparent.

6. The display system of claim 1, wherein the housing is a signholder.

7. A display system of comprising:

a housing having a front face and a rear face; and a support bar including:

an elongate body having a front face and a channel; and a first bracket secured within the channel of the elongate body, wherein the first bracket is adjustable relative to the housing in two substantially perpendicular directions;

wherein the rear face of the housing is secured to the front face of the support bar, and wherein the first bracket includes an insert arm, and wherein the insert arm includes a first slot for adjustment of the support bar in a first direction and a second slot for adjustment of the support bar in a second direction.

8. A merchandising system comprising:

a substantially transparent casing for housing signs;

a member having an extended portion and means for releasably attaching the member to the substantially transparent casing;

first means for releasably securing the member to a first fixation device; and second means for releasably securing the member to a second fixation device;

wherein at least one of the first means and the second means is adjustable in a first direction and in a second direction and wherein the second direction is substantially perpendicular to the first direction, and wherein the first means operates according to a pin-and-slot mechanism.

9. The merchandising system of claim 8, wherein the second means operates according to a pin-and-slot mechanism.

10. The merchandising system of claim 8, wherein each of the first means and the second means is adjustable in the first direction and in the second direction.

11. The merchandising system of claim 8, wherein the first means is releasably secured to a first end of the member and the second means is releasably secured to a second end of the member.

12. A merchandising system of comprising:

a substantially transparent casing for housing signs;

a member having an extended portion and means for releasably attaching the member to the substantially transparent casing;

first means for releasably securing the member to a first fixation device; and second means for releasably securing the member to a second fixation device;

wherein at least one of the first means and the second means is adjustable in a first direction and in a second direction and wherein the second direction is substantially perpendicular to the first direction, wherein at least one of the first means and the second means includes a flange and a wing, and wherein the flange includes at least one opening for receiving a pin to adjustably secure the flange to the extended portion of the member.

13. A merchandising system of comprising:

a substantially transparent casing for housing signs;

a member having an extended portion and means for releasably attaching the member to the substantially transparent casing;

first means for releasably securing the member to a first fixation device; and second means for releasably securing the member to a second fixation device;

wherein at least one of the first means and the second means is adjustable in a first direction and in a second direction and wherein the second direction is substantially perpendicular to the first direction, wherein at least one of the first means and the second means includes a flange, and wherein the flange includes a first opening for adjustment of the member in a first direction and a second opening for adjustment of the member in a second direction.

14. A method of displaying a sign comprising:

releasably attaching a channel assembly to a retail assembly, the channel assembly having a channel member, a first bracket and a second bracket secured at opposite ends of the channel member;

adjusting an overall length of the channel assembly to correspond to a distance between a first attachment site defined by a first standard and a second attachment site defined by a second standard;

adjusting an overall height of the first and second brackets relative to the channel member; and releasably securing the channel assembly to the first and second attachment sites to hang a signholder in a substantially upright position from the first and second standards, wherein at least one of the first and second brackets includes a slide portion and a tooth portion, the slide portion including a slot for receiving a fastener to limit substantially horizontal adjustment and substantially vertical adjustment of the slide portion relative to the ends of the channel member, the tooth portion adapted to be inserted into and releasably retained within the first standard.

15. The method of claim 14, performed in a retail environment.

16. The method of claim 14, wherein adjusting an overall length of the channel assembly includes telescoping the slide portion of the first bracket relative to the ends of the channel member.

17. The method of claim 14, wherein adjusting an overall height of the first and second brackets includes shifting the slide portion of the first bracket in a substantially vertical direction relative to the bottom edge of the channel member.

18. The method of claim 14, wherein the slide portion has at least a first portion and at a second portion substantially perpendicular to the first portion.

* * * * *